US012723586B2

(12) United States Patent
Yamashita et al.

(10) Patent No.: US 12,723,586 B2
(45) Date of Patent: Sep. 1, 2026

(54) SCROLL COMPRESSOR

(71) Applicant: KABUSHIKI KAISHA TOYOTA JIDOSHOKKI, Aichi-ken (JP)

(72) Inventors: Takuro Yamashita, Kariya (JP); Shiori Yamamoto, Kariya (JP); Kunihisa Matsuda, Kariya (JP); Shuto Onitsuka, Kariya (JP); Naoto Inagaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 19/068,130

(22) Filed: Mar. 3, 2025

(65) Prior Publication Data

US 2025/0297608 A1 Sep. 25, 2025

(30) Foreign Application Priority Data

Mar. 21, 2024 (JP) ..... 2024-045563

(51) Int. Cl.
*F04C 18/02* (2006.01)
*F04C 29/12* (2006.01)

(52) U.S. Cl.
CPC ..... *F04C 18/0215* (2013.01); *F04C 29/12* (2013.01)

(58) Field of Classification Search
CPC ..... F04C 18/0215; F04C 29/12
See application file for complete search history.

(56) References Cited

FOREIGN PATENT DOCUMENTS

JP S61-223288 A 10/1986
KR 20210144464 A * 11/2021 ..... F04C 29/124

OTHER PUBLICATIONS

English Machine Translation of KR 20210144464 (Year: 2021).*

* cited by examiner

*Primary Examiner* — Anthony Ayala Delgado
(74) *Attorney, Agent, or Firm* — Greenblum & Bernstein, P.L.C.

(57) ABSTRACT

A main discharge port is formed at a center of a fixed base plate. An auxiliary discharge port is formed in a portion of the fixed base plate that is different from the main discharge port. The main discharge port includes a main recess that opens toward a main reed valve so as to increase a cross-sectional area of a flow passage for the fluid. The auxiliary discharge port includes an auxiliary recess that opens toward an auxiliary reed valve so as to increase a cross-sectional area of a flow passage for the fluid. A sealing surface area, with which the fixed base plate and the auxiliary reed valve are in contact with each other to seal the auxiliary recess, is larger than a sealing surface area with which the fixed base plate and the main reed valve are in contact with each other to seal the main recess.

4 Claims, 4 Drawing Sheets

SCROLL COMPRESSOR

CROSS-REFERENCE TO RELATED APPLICATIONS

This application is based upon and claims the benefit of priority from Japanese Patent Application No. 2024-045563, filed on Mar. 21, 2024, the entire contents of which are incorporated herein by reference.

BACKGROUND

1. Field

The present disclosure relates to a scroll compressor.

2. Description of Related Art

A scroll compressor includes a housing, a rotary shaft, and a compression mechanism. The housing includes a housing suction port and a housing discharge port. The housing suction port draws in fluid. The housing discharge port discharges fluid. The rotary shaft is accommodated in the housing. The rotary shaft is supported by the housing to be rotatable about the axis of the rotary shaft. The compression mechanism is accommodated in the housing. The compression mechanism includes a fixed scroll and an orbiting scroll. The fixed scroll is fixed to the housing. The orbiting scroll orbits about the axis of the rotary shaft as the rotary shaft rotates.

The housing includes a suction chamber, compression chambers, and a discharge chamber. Fluid is drawn into the suction chamber from the housing suction port. The compression chambers are connected to the suction chamber. The fixed scroll and the orbiting scroll are meshed with each other to compress fluid in each compression chamber. The discharge chamber is connectable to the compression chambers. Fluid is discharged to the discharge chamber from each compression chamber.

The fixed scroll includes a disc-shaped fixed base plate and a spiral fixed volute wall. The fixed volute wall extends from the fixed base plate. The orbiting scroll includes a disc-shaped orbiting base plate and a spiral orbiting volute wall. The orbiting base plate faces the fixed base plate. The orbiting volute wall extends toward the fixed base plate from the orbiting base plate. The fixed base plate includes a main discharge port at the center. The main discharge port discharges compressed fluid to the discharge chamber.

In such a scroll compressor, if liquefied fluid, such as liquid refrigerant, is drawn into a compression chamber, liquid compression may occur in the compression chamber. When liquid compression occurs in a compression chamber, the pressure inside the compression chamber can become abnormally high. If such over compression occurs in a compression chamber, the fixed volute wall and the orbiting volute wall may be deformed, reducing the reliability of the scroll compressor.

In this regard, Japanese Laid-Open Patent Publication No. 61-223288 discloses a scroll compressor including an auxiliary discharge port. In the scroll compressor of Japanese Laid-Open Patent Publication No. 61-223288, the auxiliary discharge port discharges fluid in a compression chamber when the pressure in the compression chamber becomes higher than or equal to a preset pressure. With this configuration, even if liquefied fluid is drawn into a compression chamber, the liquefied fluid is discharged from the auxiliary discharge port before the pressure in the compression chamber becomes abnormally high. This prevents the pressure in the compression chambers from being abnormally high.

When such an auxiliary discharge port is formed in a portion of the fixed base plate that is different from the main discharge port, the fixed base plate is equipped with a plate-shaped main reed valve and a plate-shaped auxiliary reed valve. The main reed valve opens and closes the main discharge port. The auxiliary reed valve opens and closes the auxiliary discharge port. During normal operation of the scroll compressor, pressure fluctuation in each compression chamber may cause the auxiliary reed valve to open even though the pressure in the compression chamber has not reached the preset pressure. Accordingly, fluid that is being compressed in the compression chamber may leak to the discharge chamber via the auxiliary discharge port even though the pressure in the compression chamber has not reached the preset pressure. This may lead to a reduction in the compression efficiency of the scroll compressor.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor includes a housing, a rotary shaft, and a compression mechanism. The housing has a housing suction port that draws in fluid and a housing discharge port that discharges fluid. The rotary shaft is accommodated in the housing and is supported by the housing to be rotatable about an axis of the rotary shaft. The compression mechanism is accommodated in the housing. The compression mechanism includes a fixed scroll fixed to the housing and an orbiting scroll configured to orbit about the axis as the rotary shaft rotates. The housing includes a suction chamber into which fluid is drawn from the housing suction port, a compression chamber, and a discharge chamber. The compression chamber is connected to the suction chamber. Fluid in the compression chamber is compressed through meshing of the fixed scroll and the orbiting scroll. The discharge chamber is connectable to the compression chamber. Fluid is discharged to the discharge chamber from the compression chamber. The fixed scroll includes a disc-shaped fixed base plate and a spiral fixed volute wall extending from the fixed base plate. The orbiting scroll includes a disc-shaped orbiting base plate that faces the fixed base plate, and a spiral orbiting volute wall that extends from the orbiting base plate toward the fixed base plate. A main discharge port is formed at a center of the fixed base plate. The main discharge port discharges compressed fluid to the discharge chamber. An auxiliary discharge port is formed in a portion of the fixed base plate that is different from the main discharge port. The auxiliary discharge port discharges fluid in the compression chamber to the discharge chamber when a pressure in the compression chamber is higher than or equal to a preset pressure. The fixed base plate includes a plate-shaped main reed valve configured to open and close the main discharge port, and a plate-shaped auxiliary reed valve configured to open and close the auxiliary discharge port. The main discharge port includes a main recess that opens toward the main reed valve so as to increase a cross-sectional area of a flow passage for the fluid discharged toward the main reed valve. The auxiliary discharge port includes an auxiliary recess that opens toward the auxiliary reed valve so as to increase a cross-sectional area of a flow passage for the fluid discharged toward the auxiliary reed valve. A sealing surface area, with which the fixed base plate and the auxiliary reed valve are in contact with each other to seal the auxiliary recess, is larger than a sealing surface area with which the fixed base plate and the main reed valve are in contact with each other to seal the main recess.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

A scroll compressor 10 according to one embodiment will now be described with reference to FIGS. 1 to 7. The scroll compressor 10 of the present embodiment is used, for example, in a vehicle air conditioner.

Basic Configuration of Scroll Compressor

Figure 1:
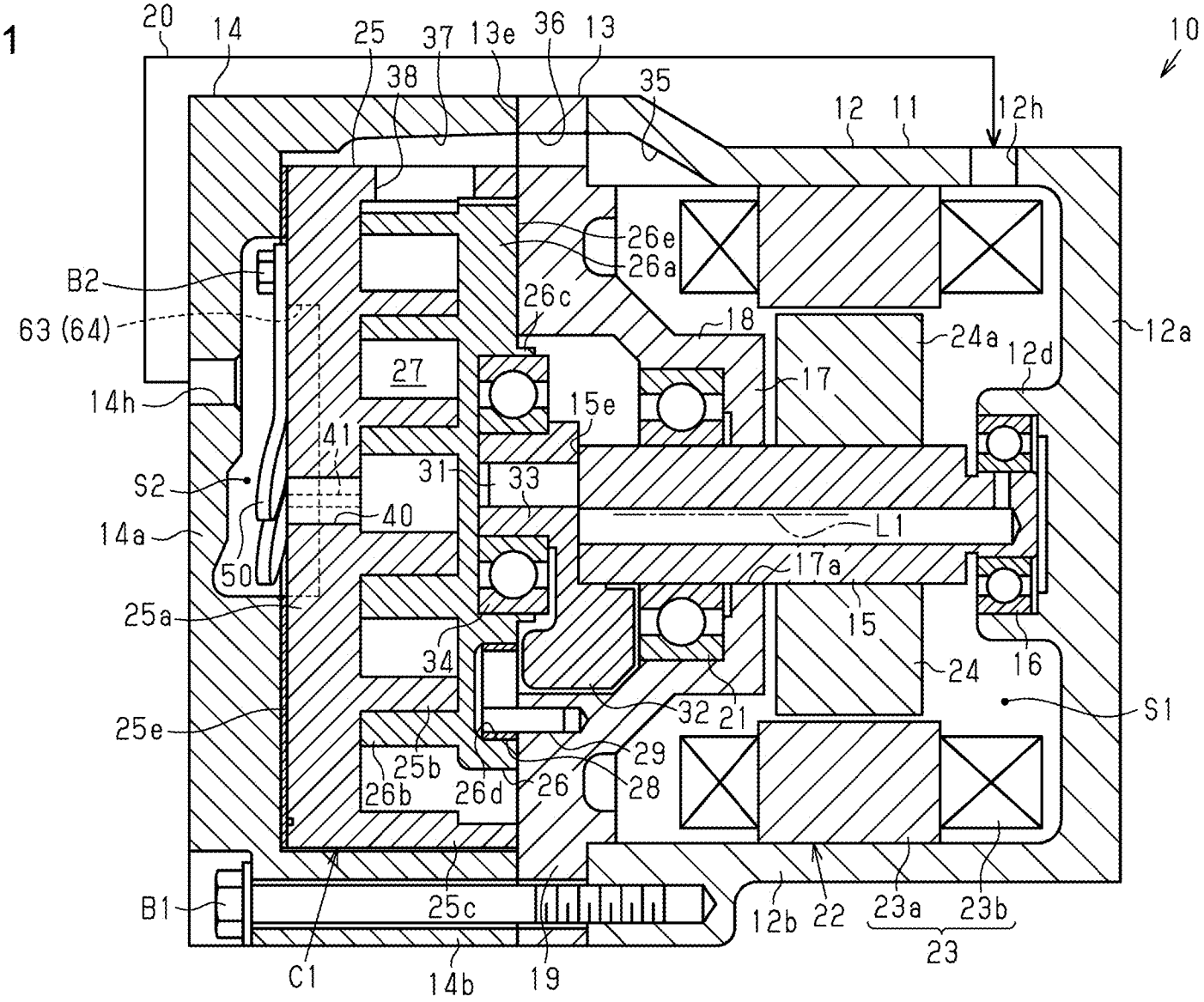
FIG. 1 is a cross-sectional view showing a scroll compressor according to an embodiment.

As shown in FIG. 1, the scroll compressor 10 includes a tubular housing 11. The housing 11 includes a motor housing member 12, a shaft support housing member 13, and a discharge housing member 14. The motor housing member 12, the shaft support housing member 13, and the discharge housing member 14 are made of metal. The motor housing member 12, the shaft support housing member 13, and the discharge housing member 14 are made of, for example, aluminum. The scroll compressor 10 includes a rotary shaft 15. The rotary shaft 15 is accommodated in the housing 11.

The motor housing member 12 includes a plate-shaped end wall 12*a* and a tubular peripheral wall 12*b*. The peripheral wall 12*b* tubularly extends from the outer periphery of the end wall 12*a*. The axial direction of the peripheral wall 12*b* agrees with the axial direction of the rotary shaft 15. The motor housing member 12 includes a housing suction port 12*h*. The housing 11 thus includes the housing suction port 12*h*. The housing suction port 12*h* is formed in the peripheral wall 12*b*. The housing suction port 12*h* is located at a position in the peripheral wall 12*b* that is relatively close to the end wall 12*a*. The housing suction port 12*h* connects the inside and the outside of the motor housing member 12. The housing suction port 12*h* draws in refrigerant gas, which is fluid.

The motor housing member 12 includes a cylindrical boss 12*d*. The boss 12*d* protrudes from the inner surface of the end wall 12*a*. The rotary shaft 15 includes a first end portion, which is one end portion in the axial direction of the rotary shaft 15, and a second end portion, which is the other end portion. The first end portion of the rotary shaft 15 is inserted into the boss 12*d*. The scroll compressor 10 includes a rolling-element bearing 16. The rolling-element bearing 16 is disposed between the inner circumferential surface of the boss 12*d* and the outer circumferential surface of the first end portion of the rotary shaft 15. The first end portion of the rotary shaft 15 is rotatably supported by the motor housing member 12 via the rolling-element bearing 16.

The shaft support housing member 13 includes a disc-shaped end wall 17 and a tubular peripheral wall 18. The peripheral wall 18 tubularly extends from the outer periphery of the end wall 17. The axial direction of the peripheral wall 18 agrees with the axial direction of the rotary shaft 15. The shaft support housing member 13 includes an annular flange wall 19. The flange wall 19 extends outward in the radial direction of the rotary shaft 15 from an end portion of the outer circumferential surface of the peripheral wall 18. Specifically, the flange wall 19 extends from an end portion that is on the side opposite to the end wall 17. The outer periphery of the flange wall 19 is in contact with an opening end of the peripheral wall 12*b* of the motor housing member 12.

The shaft support housing member 13 includes an insertion hole 17*a*. The insertion hole 17*a* is formed at the center of the end wall 17. The insertion hole 17*a* extends through the end wall 17 in the thickness direction. The rotary shaft 15 extends through the insertion hole 17*a*. An end face 15*e* of the second end portion of the rotary shaft 15 is located inside the peripheral wall 18. The scroll compressor 10 includes a rolling-element bearing 21. The rolling-element bearing 21 is disposed between the inner circumferential surface of the peripheral wall 18 and the outer circumferential surface of the rotary shaft 15. The rotary shaft 15 is rotatably supported by the shaft support housing member 13 via the rolling-element bearing 21. In this manner, the rotary shaft 15 is supported by the housing 11 so as to be rotatable about the axis L1.

The housing 11 includes a motor chamber S1. The motor chamber S1 is defined by the motor housing member 12 and the shaft support housing member 13. The motor chamber S1 is connected to the housing suction port 12*h*. Refrigerant gas is drawn into the motor chamber S1 through the housing suction port 12*h*. Thus, the motor chamber S1 is a suction chamber into which refrigerant gas is drawn from the housing suction port 12*h*. The housing 11 therefore includes a suction chamber.

The scroll compressor 10 includes a motor 22. The motor 22 is accommodated in the motor chamber S1. The motor 22 includes a tubular stator 23 and a tubular rotor 24. The rotor 24 is located on the inner side of the stator 23. The rotor 24 rotates integrally with the rotary shaft 15. The stator 23 surrounds the rotor 24. The rotor 24 includes a rotor core 24*a*, which is fixed to the rotary shaft 15, and permanent magnets (not shown), which are provided on the rotor core 24*a*. The stator 23 includes a tubular stator core 23*a* and a coil 23*b*. The stator core 23*a* is fixed to the inner circumferential surface of the peripheral wall 12*b* of the motor housing member 12. The coil 23*b* is wound about the stator core 23*a*. When power that is controlled by an inverter (not shown) is supplied to the coil 23*b*, the rotor 24 rotates. Accordingly, the rotary shaft 15 rotates integrally with the rotor 24

The scroll compressor 10 includes a compression mechanism C1. The compression mechanism C1 includes a fixed scroll 25 and an orbiting scroll 26. The fixed scroll 25 includes a disc-shaped fixed base plate 25*a* and a spiral fixed volute wall 25*b*. The fixed volute wall 25*b* extends from the fixed base plate 25*a*. The fixed scroll 25 includes a fixed outer peripheral wall 25*c*. The fixed outer peripheral wall 25*c* protrudes cylindrically from the outer periphery of the fixed base plate 25*a*. The fixed outer peripheral wall 25*c* surrounds the fixed volute wall 25*b*. The open end face of the fixed outer peripheral wall 25*c* is at the opposite side of the distal end face of the fixed volute wall 25*b* from the fixed base plate 25*a*. In other words, the fixed outer peripheral wall 25*c* protrudes further from the fixed base plate 25*a* than the fixed volute wall 25*b*.

The orbiting scroll 26 includes a disc-shaped orbiting base plate 26*a* and a spiral orbiting volute wall 26*b*. The orbiting base plate 26*a* faces the fixed base plate 25*a*. The orbiting volute wall 26*b* extends from the orbiting base plate 26*a* toward the fixed base plate 25*a*. The orbiting volute wall 26*b* meshes with the fixed volute wall 25*b*. The orbiting volute wall 26*b* is located on the inner side of the fixed outer peripheral wall 25*c*. The distal end face of the fixed volute wall 25*b* is in contact with the orbiting base plate 26*a*. The distal end face of the orbiting volute wall 26*b* is in contact with the fixed base plate 25*a*. The fixed base plate 25*a*, the fixed volute wall 25*b*, the orbiting base plate 26*a*, and the orbiting volute wall 26*b* define compression chambers 27. In other words, the fixed scroll 25 and the orbiting scroll 26 define the compression chambers 27. Refrigerant gas is compressed in each compression chamber 27. In this manner, the fixed scroll 25 and the orbiting scroll 26 are meshed with each other to define the compression chambers 27, in which the refrigerant gas is compressed. Accordingly, the compression chambers 27 are defined in the housing 11.

The orbiting scroll 26 includes a cylindrical boss 26*c*. The orbiting base plate 26*a* includes an end face 26*e* on a side opposite to the fixed base plate 25*a*, and the boss 26*c* protrudes from the center of the end face 26*e*. The axial direction of the boss 26*c* agrees with the axial direction of the rotary shaft 15.

The orbiting scroll 26 includes recesses 26*d*. The recesses 26*d* are formed around the boss 26*c* in the end face 26*e* of the orbiting base plate 26*a*. The recesses 26*d* are arranged at predetermined intervals in the circumferential direction of the rotary shaft 15. For illustrative purposes, only one of the recesses 26*d* is illustrated in FIG. 1. An annular ring member 28 is fitted in each of the recesses 26*d*. The scroll compressor 10 includes pins 29. The pins 29 are provided on the shaft support housing member 13. The shaft support housing member 13 includes an end face 13*e* that faces the orbiting scroll 26. The pins 29 protrude from the end face 13*e* of the shaft support housing member 13. The pins 29 are inserted into the ring members 28.

The scroll compressor 10 includes an eccentric shaft 31. The eccentric shaft 31 protrudes from the end face 15*e* of the rotary shaft 15 toward the orbiting scroll 26. The eccentric shaft 31 is located at a portion of the end face 15*e* of the rotary shaft 15 that is eccentric to the axis L1 of the rotary shaft 15. The eccentric shaft 31 is formed integrally with the rotary shaft 15. The axial direction of the eccentric shaft 31 agrees with the axial direction of the rotary shaft 15. The eccentric shaft 31 is inserted into the boss 26*c*.

The scroll compressor 10 includes a balance weight 32 and a bushing 33. The balance weight 32 is integrated with the bushing 33. The bushing 33 is fitted about the outer circumferential surface of the eccentric shaft 31. The balance weight 32 is formed integrally with the bushing 33. The balance weight 32 is accommodated in the peripheral wall 18 of the shaft support housing member 13. The orbiting scroll 26 is supported by the eccentric shaft 31 via the bushing 33 and the rolling-element bearing 34 so as to be rotatable relative to the eccentric shaft 31.

Rotation of the rotary shaft 15 is transmitted to the orbiting scroll 26 via the eccentric shaft 31, the bushing 33, and the rolling-element bearing 34. Specifically, contact between the pins 29 and the inner circumferential surfaces of the ring members 28 prevents the orbiting scroll 26 from rotating and only allows the orbiting scroll 26 to orbit. As a result, the orbiting scroll 26 orbits about the axis L1 of the rotary shaft 15 with the orbiting volute wall 26*b* being in contact with the fixed volute wall 25*b*, and the volume of each compression chamber 27 decreases to compress refrigerant gas. The orbiting scroll 26 thus orbits about the axis L1 of the rotary shaft 15 as the rotary shaft 15 rotates. The balance weight 32 counteracts the centrifugal force acting on the orbiting scroll 26 when the orbiting scroll 26 orbits, thereby reducing the amount of imbalance of the orbiting scroll 26.

The discharge housing member 14 includes a plate-shaped end wall 14*a* and a tubular peripheral wall 14*b*. The peripheral wall 14*b* tubularly extends from the outer periphery of the end wall 14*a*. The axial direction of the peripheral wall 14*b* agrees with the axial direction of the rotary shaft 15. The peripheral wall 14*b* includes an opening end that is in contact with the outer periphery of the flange wall 19. The peripheral wall 14*b* surrounds the fixed scroll 25. Thus, the fixed scroll 25 is accommodated in the housing 11. In this manner, the compression mechanism C1 is accommodated in the housing 11.

The discharge housing member 14, the shaft support housing member 13, and the motor housing member 12 are fixed to each other with bolts B1. The bolts B1 extend through the peripheral wall 14*b* of the discharge housing member 14 and the outer periphery of the flange wall 19 so as to be threaded into the peripheral wall 12*b* of the motor housing member 12. This couples the shaft support housing member 13 to the peripheral wall 12*b* of the motor housing member 12, and couples the discharge housing member 14 to the flange wall 19 of the shaft support housing member 13. Accordingly, the motor housing member 12, the shaft support housing member 13, and the discharge housing member 14 are arranged in that order in the axial direction of the rotary shaft 15.

The fixed scroll 25 is held between the end wall 14*a* of the discharge housing member 14 and the shaft support housing member 13. The fixed scroll 25 is thus fixed to the housing 11.

The scroll compressor 10 includes a discharge chamber S2. The discharge chamber S2 is formed in the discharge housing member 14. The discharge chamber S2 is defined by the discharge housing member 14 and the fixed base plate 25*a* of the fixed scroll 25. The housing 11 therefore includes the discharge chamber S2. Refrigerant gas is discharged from the compression chambers 27 into the discharge chamber S2.

The discharge housing member 14 includes a housing discharge port 14*h*. The housing 11 thus includes the housing discharge port 14*h*. The housing discharge port 14*h* is formed in the end wall 14*a* of the discharge housing member 14. The housing discharge port 14*h* is connected to the discharge chamber S2. The housing discharge port 14*h* discharges refrigerant gas in the discharge chamber S2.

The housing discharge port 14*h* and the housing suction port 12*h* are connected to each other via an external refrigerant circuit 20. The external refrigerant circuit 20 includes a condenser, an expansion valve, and an evaporator, none of which are shown. The refrigerant gas discharged from the housing discharge port 14*h* flows through the external refrigerant circuit 20. The refrigerant gas in the external refrigerant circuit 20 flows through the condenser, the expansion valve, and the evaporator to return to the motor chamber S1 via the housing suction port 12*h*. The scroll compressor 10 and the external refrigerant circuit 20 form the vehicle air conditioner.

The scroll compressor 10 includes first grooves 35, first holes 36, second grooves 37, and second holes 38. The first grooves 35 are formed in the inner circumferential surface of the peripheral wall 12*b* of the motor housing member 12. The first grooves 35 open in the opening end of the peripheral wall 12*b*. The first holes 36 are formed in the outer circumferential portion of the flange wall 19 of the shaft support housing member 13. The first holes 36 extend through the flange wall 19 in the thickness direction. The first holes 36 are connected to the first grooves 35. The second grooves 37 are formed in the inner circumferential surface of the peripheral wall 14*b* of the discharge housing member 14. The second grooves 37 are connected to the first holes 36. For the illustrative purposes, one of the first grooves 35, one of the first holes 36, and one of the second groove 37 are shown in FIG. 1.

The second holes 38 are formed in the fixed outer peripheral wall 25*c* of the fixed scroll 25. The second holes 38 each extend through the fixed outer peripheral wall 25*c* in the thickness direction. The second holes 38 are connected to the second grooves 37. The second holes 38 are connected to the outermost parts of the compression chambers 27. Accordingly, the compression chambers 27 are connected to the motor chamber S1 via the first grooves 35, the first holes 36, the second grooves 37, and the second holes 38. The refrigerant gas in the motor chamber S1 is drawn into the compression chambers 27 through the first grooves 35, the first holes 36, the second grooves 37, and the second holes 38. The refrigerant gas drawn into the compression chambers 27 is compressed in the compression chambers 27 through the orbital motion of the orbiting scroll 26.

Main Discharge Port

Figure 2:
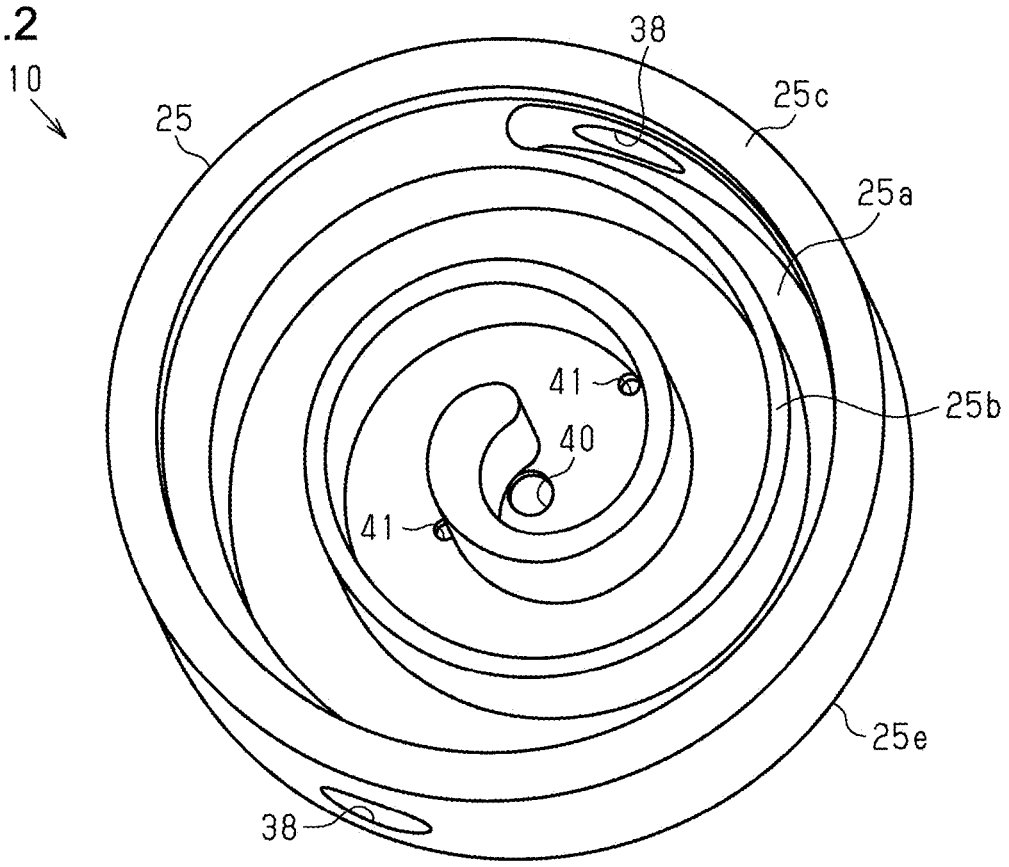
FIG. 2 is a perspective view of a fixed scroll of the scroll compressor shown in FIG. 1.

As shown in FIGS. 1 and 2, the fixed base plate 25*a* includes a main discharge port 40 at the center. The main discharge port 40 is a circular hole. The main discharge port 40 extends through the fixed base plate 25*a* in the thickness direction. The main discharge port 40 includes a first end, which is one open end in the axial direction of the main discharge port 40, and a second end, which is the other open end. The first end of the main discharge port 40 is connected to the compression chambers 27. The second end of the main discharge port 40 is connected to the discharge chamber S2. This allows the discharge chamber S2 to be connected to the compression chambers 27 via the main discharge port 40. The main discharge port 40 discharges the refrigerant gas compressed in the compression chambers 27 to the discharge chamber S2.

Auxiliary Discharge Ports

Figure 3:
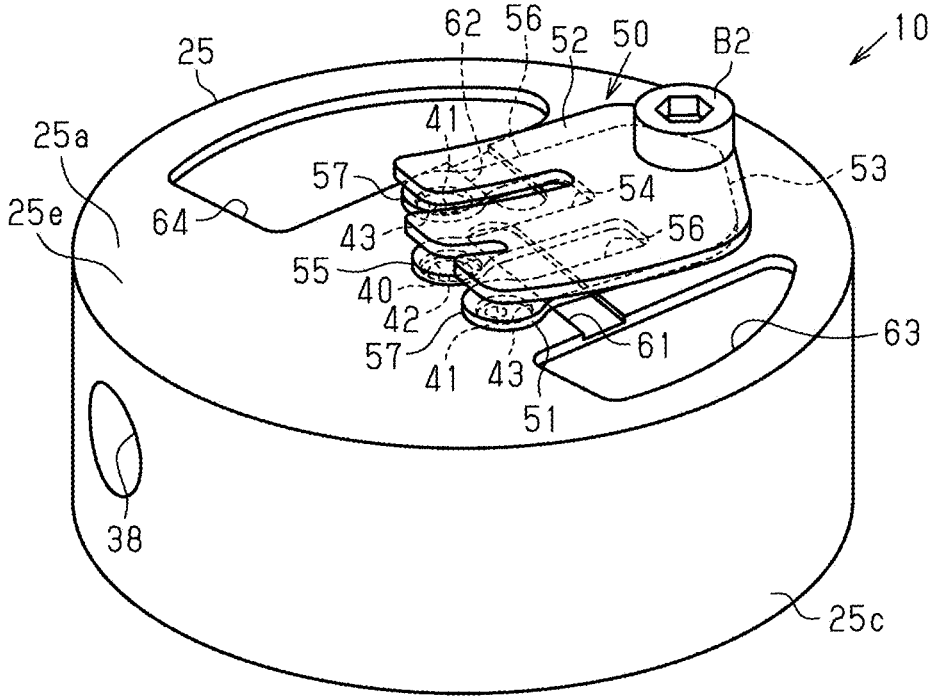
FIG. 3 is a perspective view of the fixed scroll shown in FIG. 2 and a valve mechanism.

As shown in FIGS. 2 and 3, two auxiliary discharge ports 41 are formed in portions of the fixed base plate 25*a* that are different from the main discharge port 40. The two auxiliary discharge ports 41 are arranged on opposite sides of the main discharge port 40. The auxiliary discharge ports 41 are circular holes. The auxiliary discharge ports 41 extend through the fixed base plate 25*a* in the thickness direction. The auxiliary discharge ports 41 each have a smaller diameter than that of the main discharge port 40.

As shown in FIG. 1, the auxiliary discharge ports 41 each include a first end, which is one open end in the axial direction of the auxiliary discharge port 41, and a second end, which is the other open end. The first ends of the auxiliary discharge ports 41 are connected to the compression chambers 27. The second ends of the auxiliary discharge ports 41 are connected to the discharge chamber S2. The auxiliary discharge ports 41 discharge the refrigerant gas in the compression chambers 27 to the discharge chamber S2 when the pressure in the compression chambers 27 are higher than or equal to a preset pressure.

Main Recess

Figure 4:
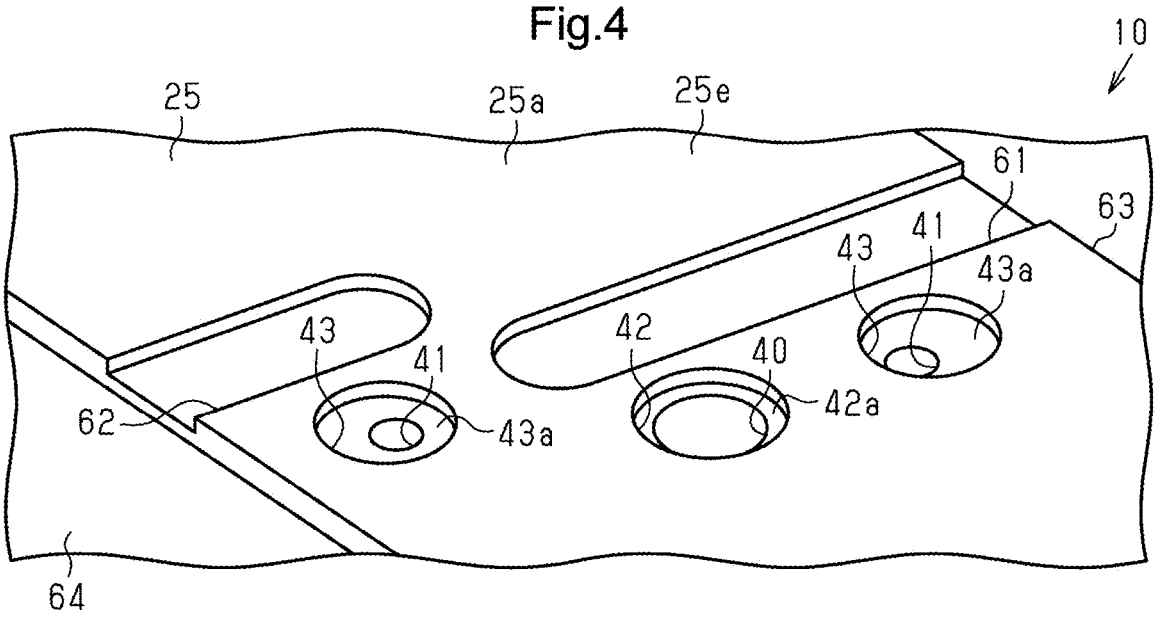
FIG. 4 is an enlarged perspective view of a portion of the fixed scroll shown in FIG. 2.
Figure 5:
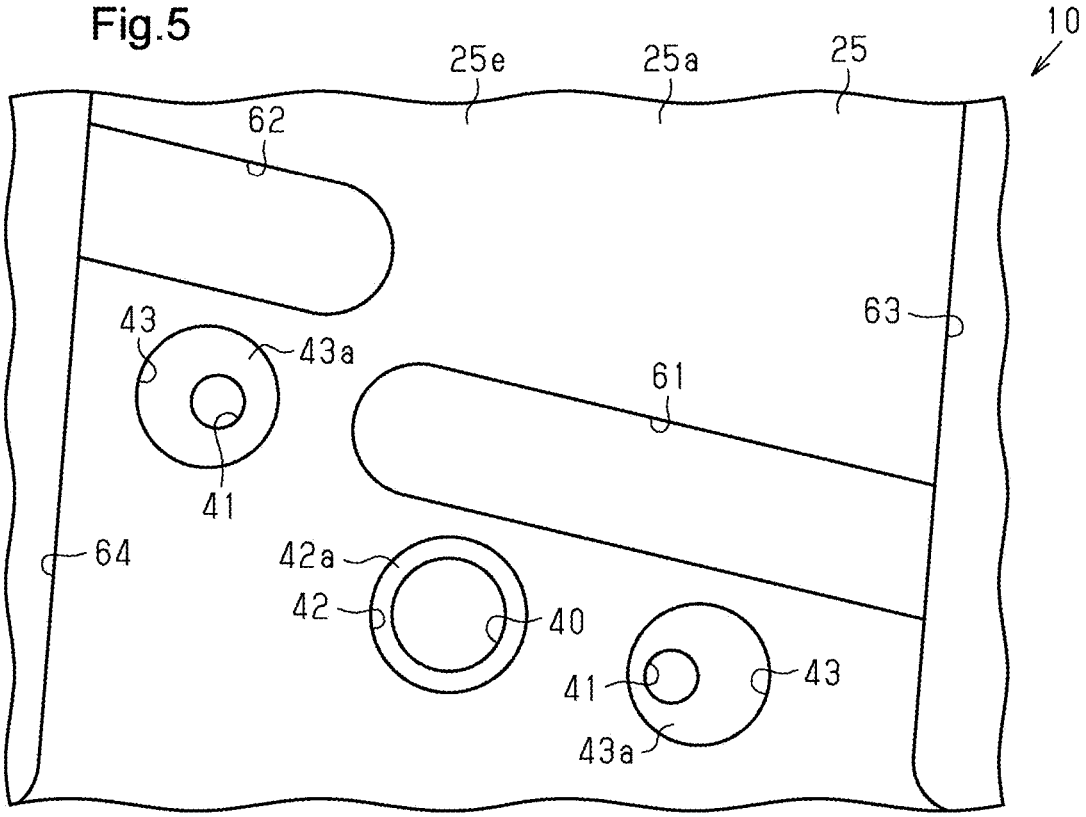
FIG. 5 is an enlarged plan view of a portion of the fixed scroll shown in FIG. 2.

As shown in FIGS. 4 and 5, the main discharge port 40 includes a main recess 42. The main recess 42 opens in a base plate end face 25*e* of the fixed base plate 25*a* that is on the side opposite to the fixed volute wall 25*b*. The main recess 42 is circular. The main recess 42 has a larger diameter than that of the main discharge port 40. The main discharge port 40 is open in a bottom surface 42*a* of the main recess 42. The axis of the main recess 42 agrees with the axis of the main discharge port 40.

Auxiliary Recesses

The auxiliary discharge ports 41 each include an auxiliary recess 43. The auxiliary recesses 43 open in the base plate end face 25*e* of the fixed base plate 25*a*. The auxiliary recesses 43 are circular holes. The auxiliary recesses 43 each have a larger diameter than that of the auxiliary discharge ports 41. Each auxiliary discharge port 41 opens in a bottom surface 43*a* of the corresponding auxiliary recess 43. The axis of each auxiliary recess 43 is offset from the axis of the corresponding auxiliary discharge port 41. The auxiliary recesses 43 each have a smaller diameter than that of the main recess 42. The auxiliary recesses 43 thus each have a smaller opening area than the main recess 42.

Reed Valve Unit

As shown in FIG. 3, the scroll compressor 10 includes a valve mechanism 50. The valve mechanism 50 is provided on the base plate end face 25*e* of the fixed base plate 25*a*. The valve mechanism 50 includes a reed valve unit 51 and a retainer 52.

Figure 6:
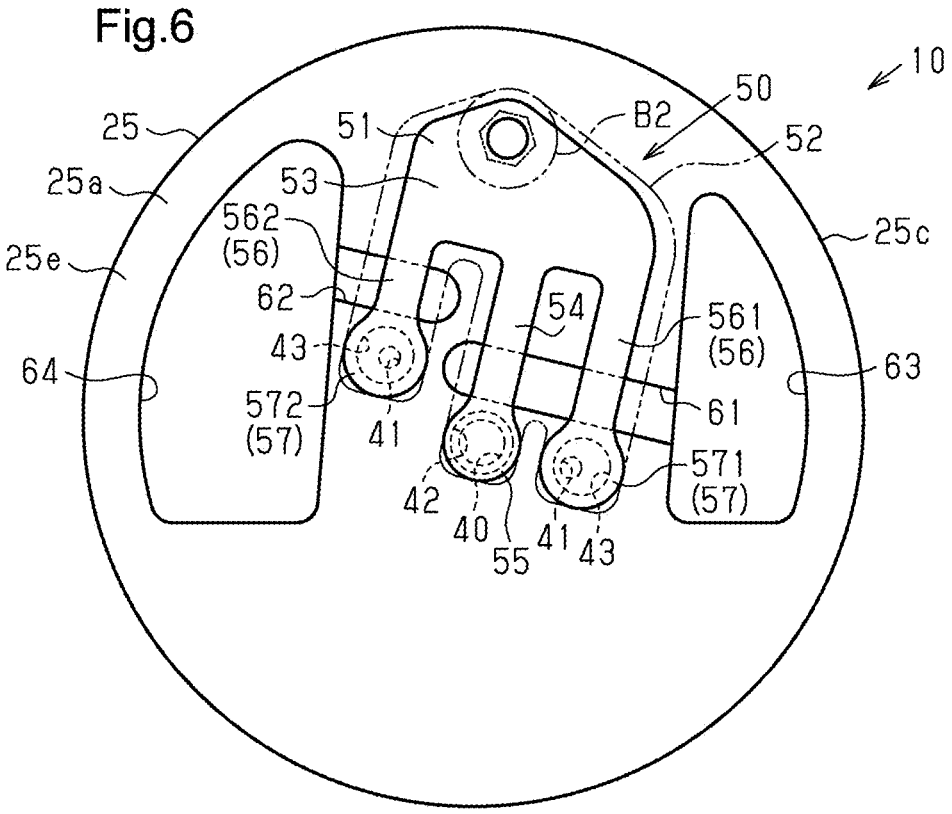
FIG. 6 is a plan view of the fixed scroll shown in FIG. 2 and a reed valve unit.
Figure 7:
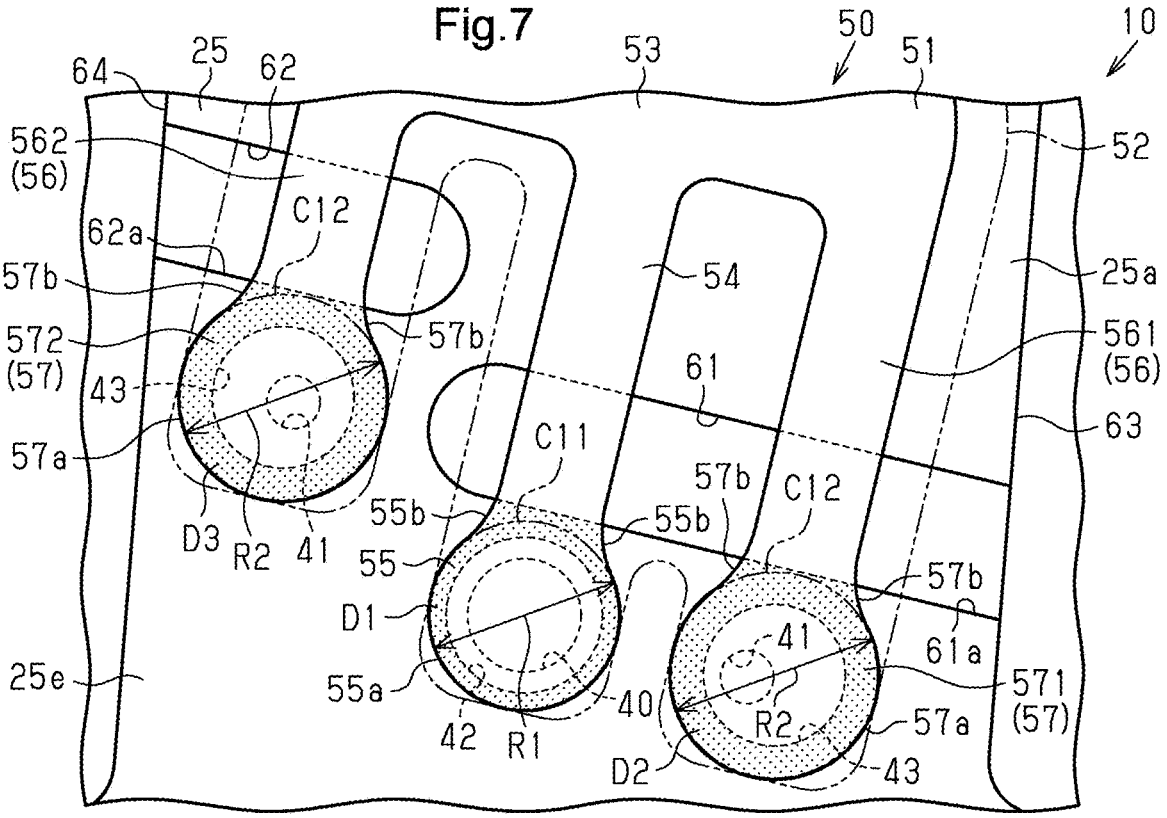
FIG. 7 is an enlarged plan view partially showing the fixed scroll shown in FIG. 2 and the reed valve unit.

As shown in FIGS. 6 and 7, the reed valve unit 51 is an elastically deformable thin plate. The reed valve unit 51 is a metal plate. The reed valve unit 51 includes a fixed portion 53, a main arm 54, a main reed valve 55, two auxiliary arms 56, and two auxiliary reed valves 57. The fixed portion 53, the main arm 54, the main reed valve 55, the two auxiliary arms 56, and the two auxiliary reed valves 57 are integrally formed from a single metal plate.

The fixed portion 53 has the shape of an elongated substantially rectangular plate. The fixed portion 53 of the reed valve unit 51 is fixed to the base plate end face 25*e* of the fixed base plate 25*a*. The fixed portion 53 is fixed to the base plate end face 25*e* with the thickness direction of the fixed portion 53 agreeing with the thickness direction of the fixed base plate 25*a*.

The main arm 54 and the auxiliary arms 56 each have the shape of an elongated rectangular plate. The main arm 54 and the two auxiliary arms 56 extend from the fixed portion 53 in a state in which their longitudinal directions agree with each other. In other words, the main arm 54 and the two auxiliary arms 56 extend from the fixed portion 53 while being parallel with each other. The thickness direction of the main arm 54 and the thickness direction of the auxiliary arms 56 agree with the thickness direction of the fixed portion 53. The main arm 54 extends from a central portion of the fixed portion 53 in the longitudinal direction. The two auxiliary arms 56 extend from sections of the fixed portion 53 that are located at the opposite sides of the main arm 54 in the longitudinal direction of the fixed portion 53. The longitudinal direction of the main arm 54 and the auxiliary arms 56 is orthogonal to the longitudinal direction of the fixed portion 53. The main arm 54 extends from the fixed portion 53 toward the main discharge port 40. The two auxiliary arms 56 each extend from the fixed portion 53 toward the corresponding auxiliary discharge port 41.

The main reed valve 55 is continuous with an end of the main arm 54 that is opposite to the fixed portion 53. The main reed valve 55 is substantially disc-shaped. The main reed valve 55 is configured to close the main recess 42.

As shown in FIG. 7, the main reed valve 55 includes a contour edge 55*a* and two connecting edges 55*b*. The contour edge 55*a* is a part of the outer edge of the main reed valve 55 that extends along the opening edge of the main recess 42. The contour edge 55*a* has an outer diameter R1 that is slightly larger than the outer diameter of the opening edge of the main recess 42. The connecting edges 55*b* are parts of the outer edge of the main reed valve 55 that connect the contour edge 55*a* to the outer edge of the main arm 54. An imaginary circle that extends along the contour edge 55*a* is referred to as an imaginary circle C11.

The main reed valve 55 is arranged in relation to the fixed base plate 25*a* such that the axis of the main recess 42 agrees with the center of the imaginary circle C11. Thus, when the main reed valve 55 closes the main recess 42, the outer peripheral portion of the main reed valve 55 is in contact with the base plate end face 25*e* of the fixed base plate 25*a*. The main reed valve 55 seals the main recess 42 through contact between the fixed base plate 25*a* and the main reed valve 55. The main reed valve 55 is capable of opening and closing the main discharge port 40. The fixed base plate 25*a* is thus provided with the plate-shaped main reed valve 55, which opens and closes the main discharge port 40. The main recess 42 opens toward the main reed valve 55 so as to increase the cross-sectional area of a flow passage for the refrigerant gas discharged toward the main reed valve 55.

The auxiliary reed valves 57 are each continuous with an end of the corresponding auxiliary arm 56 on a side opposite to the fixed portion 53. The auxiliary reed valves 57 are substantially disc-shaped. The auxiliary reed valves 57 are configured to close the auxiliary recesses 43.

Each auxiliary reed valve 57 includes a contour edge 57*a* and two connecting edges 57*b*. The contour edge 57*a* is a part of the outer edge of the auxiliary reed valve 57 that extends along the opening edge of the corresponding auxiliary recess 43 and has an outer diameter R2 that is slightly larger than the outer diameter of the opening edge of the auxiliary recess 43. The connecting edges 57*b* are parts of the outer edge of the auxiliary reed valve 57 that connect the contour edge 57*a* to the outer edge of the auxiliary arm 56. An imaginary circle that extends along the contour edge 57*a* is referred to as an imaginary circle C12.

Each auxiliary reed valve 57 is arranged in relation to the fixed base plate 25*a* such that the axis of the corresponding auxiliary recess 43 agrees with the center of the imaginary circle C12. Thus, when the auxiliary reed valve 57 closes the auxiliary recess 43, the outer peripheral portion of the auxiliary reed valve 57 is in contact with the base plate end face 25*e* of the fixed base plate 25*a*. The auxiliary reed valve 57 seals the auxiliary recess 43 through contact between the fixed base plate 25*a* and the auxiliary reed valve 57. The auxiliary reed valve 57 is capable of opening and closing the auxiliary discharge port 41. The fixed base plate 25*a* is thus provided with the plate-shaped auxiliary reed valves 57, which open and close the auxiliary discharge ports 41. The auxiliary recesses 43 each open to the corresponding auxiliary reed valve 57 so as to increase the cross-sectional area of the flow passage for the refrigerant gas discharged toward the auxiliary reed valve 57.

The outer diameter R2 of the contour edge 57*a* of each auxiliary reed valve 57 is larger than the outer diameter R1 of the contour edge 55*a* of the main reed valve 55. Therefore, the auxiliary reed valve 57 has a larger area than the main reed valve 55.

As shown in FIG. 3, the retainer 52 is a plate thicker than the reed valve unit 51. The retainer 52 and the reed valve unit 51 are attached to the fixed base plate 25*a* by threading a bolt B2, which extends through the retainer 52 and the fixed portion 53 of the reed valve unit 51, into the fixed base plate 25*a*.

The main reed valve 55 is connected to the fixed base plate 25*a* by the main arm 54 and the fixed portion 53. The main arm 54 is thus disposed between the main reed valve 55 and the fixed base plate 25*a* so as to connect the main reed valve 55 and the fixed base plate 25*a* to each other. The auxiliary reed valves 57 are connected to the fixed base plate 25*a* by the auxiliary arms 56 and the fixed portion 53. The auxiliary arms 56 are thus disposed between the auxiliary reed valves 57 and the fixed base plate 25*a* so as to connect the auxiliary reed valves 57 and the fixed base plate 25*a* to each other.

The retainer 52 is bent so as to be gradually separated from the fixed base plate 25*a* from the fixed portion 53 toward the distal ends of the main reed valve 55 and the auxiliary reed valves 57. This structure allows the main reed valve 55 to swing integrally with the main arm 54 about the portion of the main arm 54 connected to the fixed portion 53 and in a direction toward and away from the fixed base plate 25*a*. This structure also allows each auxiliary reed valve 57 to swing integrally with the corresponding auxiliary arm 56 about the portion of the auxiliary arm 56 connected to the fixed portion 53 and in a direction toward and away from the fixed base plate 25*a*.

The main reed valve 55 opens the main recess 42 when the main reed valve 55 swings away from the fixed base plate 25*a* from the state in which the main reed valve 55 closes the main recess 42. Also, each auxiliary reed valve 57 opens the corresponding auxiliary recess 43 when the auxiliary reed valve 57 swings away from the fixed base plate 25*a* from the state in which the auxiliary reed valve 57 closes the auxiliary recess 43. The retainer 52 regulates the opening degrees of the main reed valve 55 and the auxiliary reed valves 57.

Main Groove and Auxiliary Groove

As shown in FIGS. 6 and 7, the fixed base plate 25*a* includes a first relief groove 61, a second relief groove 62, a first relief recess 63, and a second relief recess 64, which are formed in the base plate end face 25*e*. In the following description, one of the two auxiliary arms 56 may be referred to as a first auxiliary arm 561, and the other may be referred to as a second auxiliary arm 562. The first relief groove 61 extends in a direction that is orthogonal to the extending direction of the main arm 54 and to the extending direction of the first auxiliary arm 561. When the base plate end face 25*e* is viewed in plan view, the first relief groove 61 partially overlaps with the main arm 54 and the first auxiliary arm 561. Thus, the main arm 54 and the first auxiliary arm 561 pass across the first relief groove 61. In this manner, the first relief groove 61 is orthogonal to the extending direction of the main arm 54 and the extending direction of the first auxiliary arm 561 and is not in contact with the main arm 54 and the first auxiliary arm 561.

Thus, the first relief groove 61 acts as a recessed main groove that intersects with the extending direction of the main arm 54 and is not in contact with the main arm 54. The first relief groove 61 also acts as a recessed auxiliary groove that intersects with the extending direction of the first auxiliary arm 561 and is not in contact with the first auxiliary arm 561. In this manner, the fixed base plate 25*a* includes a recessed main groove that intersects with the extending direction of the main arm 54 and is not in contact with the main arm 54. The fixed base plate 25*a* also includes a recessed auxiliary groove that intersects with the extending direction of the first auxiliary arm 561 and is not in contact with the first auxiliary arm 561.

The second relief groove 62 extends in a direction orthogonal to the extending direction of the second auxiliary arm 562. When the base plate end face 25*e* is viewed in plan view, the second relief groove 62 partially overlaps with the second auxiliary arm 562. Thus, the second auxiliary arm 562 passes across the second relief groove 62. In this manner, the second relief groove 62 is orthogonal to the extending direction of the second auxiliary arm 562 and is not in contact with the second auxiliary arm 562.

Accordingly, the second relief groove 62 acts as a recessed auxiliary groove that intersects with the extending direction of the second auxiliary arm 562 and is not in contact with the second auxiliary arm 562.

The first relief groove 61 includes a first end, which is one of the ends in the extending direction of the first relief groove 61, and a second end, which is the other end. The first end of the first relief groove 61 is closed. The second end of the first relief groove 61 is continuous with the first relief recess 63. The first relief recess 63 is continuous with the discharge chamber S2. The second relief groove 62 includes a first end, which is one of the ends in the extending direction of the second relief groove 62, and a second end, which is the other end. The first end of the second relief groove 62 is closed. The second end of the second relief groove 62 is continuous with the second relief recess 64. The second relief recess 64 is continuous with the discharge chamber S2.

Sealing Surface Size

The first relief groove 61 has two side edges extending in the extending direction. One of the side edges that is located on the side on which the main discharge port 40 is disposed is referred to as an open edge 61*a*. When the base plate end face 25*e* is viewed in plan view, the main reed valve 55 is located in a portion that is on the side of the open edge 61*a* of the first relief groove 61 on which the main discharge port 40 is provided, as shown in FIG. 7. The sealing surface area (the size of contacting region) with which the fixed base plate 25*a* and the main reed valve 55 are in contact with each other to seal the main recess 42 is defined by contact between the main reed valve 55 and a portion of the fixed base plate 25*a* that is on the side of the first relief groove 61 on which the main discharge port 40 is disposed. In FIG. 7, the stippling region D1 indicates a portion in which the fixed base plate 25*a* and the main reed valve 55 are in contact with each other. The sealing surface area with which the fixed base plate 25*a* and the main reed valve 55 are in contact with each other to seal the main recess 42 corresponds to the size of the stippling region D1.

In the following description, one of the two auxiliary reed valves 57 may be referred to as a first auxiliary reed valve 571, and the other may be referred to as a second auxiliary reed valve 572. When the base plate end face 25*e* is viewed in plan view, the first auxiliary reed valve 571 is located in a portion that is on a side of the open edge 61*a* of the first relief groove 61 and includes the corresponding auxiliary discharge port 41. The sealing surface area with which the fixed base plate 25*a* and the first auxiliary reed valve 571 are in contact with each other to seal the corresponding auxiliary recess 43 is defined by contact between the first auxiliary reed valve 571 and a portion of the fixed base plate 25*a* that is on the side of the first relief groove 61 on which the corresponding auxiliary discharge port 41 is disposed. In FIG. 7, the stippling region D2 indicates a portion in which the fixed base plate 25*a* and the first auxiliary reed valve 571 are in contact with each other. The sealing surface area with which the fixed base plate 25*a* and the first auxiliary reed valve 571 are in contact with each other to seal the corresponding auxiliary recess 43 corresponds to the size of the stippling region D2.

The second relief groove 62 has two side edges extending in the extending direction. One of the side edges that is located on the side at which the corresponding auxiliary discharge port 41 is disposed is referred to as an open edge 62*a*. When the base plate end face 25*e* is viewed in plan view, the second auxiliary reed valve 572 is located in a portion that is on a side of the open edge 62*a* of the second relief groove 62 and includes the corresponding auxiliary discharge port 41. The sealing surface area with which the fixed base plate 25*a* and the second auxiliary reed valve 572 are in contact with each other to seal the corresponding auxiliary recess 43 is defined by contact between the second auxiliary reed valve 572 and a portion of the fixed base plate 25*a* that is on the side of the second relief groove 62 on which the corresponding auxiliary discharge port 41 is disposed. In FIG. 7, the stippling region D3 indicates a portion in which the fixed base plate 25*a* and the second auxiliary reed valve 572 are in contact with each other. The sealing surface area with which the fixed base plate 25*a* and the second auxiliary reed valve 572 are in contact with each other to seal the corresponding auxiliary recess 43 corresponds to the size of the stippling region D3.

The open area of each auxiliary recess 43 is smaller than the open area of the main recess 42, and the area of each auxiliary reed valve 57 is larger than the area of the main reed valve 55. Thus, each of the stippling region D2 and the stippling region D3 is larger in area than the stippling region D1. Thus, the sealing surface area with which the fixed base plate 25*a* and the first auxiliary reed valve 571 are in contact with each other to seal the corresponding auxiliary recess 43 and the sealing surface area with which the fixed base plate 25*a* and the second auxiliary reed valve 572 are in contact with each other to seal the corresponding auxiliary recess 43 are larger than the sealing surface area with which the fixed base plate 25*a* and the main reed valve 55 are in contact with each other to seal the main recess 42.

Operation of the Embodiment

Operation of the present embodiment will now be described.

Refrigerant gas that is compressed in the compression chambers 27 and discharged from the main discharge port 40 is discharged to the discharge chamber S2 by flexing the main reed valve 55.

In the scroll compressor 10, if liquid refrigerant is drawn into each compression chamber 27, liquid compression may occur in the compression chamber 27. When liquid compression occurs in the compression chamber 27, the pressure inside the compression chamber 27 increases. When the pressure in the compression chamber 27 is higher than or equal to the preset pressure, the liquid refrigerant is discharged from the auxiliary discharge port 41 to the discharge chamber S2 by flexing the auxiliary reed valves 57. Each auxiliary discharge port 41 discharges liquid refrigerant in each compression chamber 27 when the pressure in the compression chamber 27 is higher than or equal to the preset pressure. With this configuration, even if liquid refrigerant is drawn into the compression chamber 27, the liquid refrigerant is discharged from the auxiliary discharge port 41 before the pressure in the compression chamber 27 becomes abnormally high. This prevents the pressures in the compression chambers 27 from being abnormally high.

Each auxiliary reed valve 57 is arranged in relation to the fixed base plate 25*a* such that the axis of the corresponding auxiliary recess 43 agrees with the center of the imaginary circle C12. Therefore, even if the axis of each auxiliary recess 43 is offset from the axis of the auxiliary discharge port 41, the pressure of the liquid refrigerant discharged from the auxiliary discharge port 41 is prevented from acting unevenly on the auxiliary reed valve 57. As a result, the auxiliary reed valves 57 are prevented from fluttering.

The first relief groove 61 partially overlaps with the main arm 54 and the first auxiliary arm 561. This prevents the main arm 54 and the first auxiliary arm 561 from adhering to the base plate end face 25*e*. Also, foreign matter between the main arm 54 and the base plate end face 25*e* flows to the first relief groove 61 together with oil contained in the refrigerant gas. Further, foreign matter between the first auxiliary arm 561 and the base plate end face 25*e* flows to the first relief groove 61 together with oil contained in the refrigerant gas. The oil that has flowed into the first relief groove 61 flows to the discharge chamber S2 through the first relief recess 63.

The second relief groove 62 partially overlaps with the second auxiliary arm 562. Accordingly, the second auxiliary arm 562 is prevented from adhering to the base plate end face 25*e*. Also, foreign matter between the second auxiliary arm 562 and the base plate end face 25*e* flows to the second relief groove 62 together with oil contained in the refrigerant gas. The oil that has flowed into the second relief groove 62 flows to the discharge chamber S2 through the second relief recess 64.

Advantages of the Embodiment

The above-described embodiment has the following advantages.

(1) The sealing surface area with which the fixed base plate 25*a* and each auxiliary reed valve 57 are in contact with each other to seal the corresponding auxiliary recess 43 is larger than the sealing surface area with which the fixed base plate 25*a* and the main reed valve 55 are in contact with each other to seal the main recess 42. This configuration improves the sealing performance at each auxiliary recess 43 through contact between the fixed base plate 25*a* and the auxiliary reed valve 57 as compared to a case in which, for example, the sealing surface area with which the fixed base plate 25*a* and the auxiliary reed valve 57 are in contact with each other to seal the auxiliary recess 43 is smaller than or equal to the sealing surface area with which the fixed base plate 25*a* and the main reed valve 55 are in contact with each other to seal the main recess 42. This configuration avoids a situation in which, during normal operation of the scroll compressor 10, pressure fluctuation in the compression chambers 27 causes the auxiliary reed valves 57 to open even though the pressure in the compression chambers 27 has not reached the preset pressure. Therefore, it is possible to prevent the refrigerant gas that is being compressed in each compression chamber 27 from leaking to the discharge chamber S2 via the auxiliary discharge ports 41 when the pressure in the compression chamber 27 has not reached the preset pressure. This improves the compression efficiency of the scroll compressor 10.

(2) The open area of each auxiliary recess 43 is smaller than the open area of the main recess 42, and the area of each auxiliary reed valve 57 is larger than the area of the main reed valve 55. This configuration is suitable for a structure in which the sealing surface area with which the fixed base plate 25*a* and each auxiliary reed valve 57 are in contact with each other to seal the corresponding auxiliary recess 43 is larger than the sealing surface area with which the fixed base plate 25*a* and the main reed valve 55 are in contact with each other to seal the main recess 42.

(3) The sealing surface area with which the fixed base plate 25*a* and the main reed valve 55 are in contact with each other to seal the main recess 42 is defined by contact between the main reed valve 55 and a portion of the fixed base plate 25*a* that is on the side of the first relief groove 61 on which the main discharge port 40 is disposed. This configuration reliably seals the main recess 42 through contact between the fixed base plate 25*a* and the main reed valve 55 by causing the main reed valve 55 to be in contact with a portion of the fixed base plate 25*a* that is on the of the first relief groove 61 on which the main discharge port 40 is disposed.

(4) The sealing surface area with which the fixed base plate 25*a* and the first auxiliary reed valve 571 are in contact with each other to seal the corresponding auxiliary recess 43 is defined by contact between the first auxiliary reed valve 571 and a portion of the fixed base plate 25*a* that is on the side of the first relief groove 61 on which the corresponding auxiliary discharge port 41 is disposed. Also, the sealing surface area with which the fixed base plate 25*a* and the second auxiliary reed valve 572 are in contact with each other to seal the corresponding auxiliary recess 43 is defined by contact between the second auxiliary reed valve 572 and a portion of the fixed base plate 25*a* that is on the side of the second relief groove 62 on which the corresponding auxiliary discharge port 41 is disposed. This configuration reliably seals one of the auxiliary recesses 43 through contact between the fixed base plate 25*a* and the first auxiliary reed valve 571 by causing the first auxiliary reed valve 571 to be in contact with a portion of the fixed base plate 25*a* that is on the side of the first relief groove 61 on which the corresponding auxiliary discharge port 41 is disposed. This configuration also reliably seals the other auxiliary recesses 43 through contact between the fixed base plate 25*a* and the second auxiliary reed valve 572 by causing the second auxiliary reed valve 572 to be in contact with a portion of the fixed base plate 25*a* that is on the side of the second relief groove 62 on which the corresponding auxiliary discharge port 41 is disposed.

Modifications

The above-described embodiment may be modified as follows. The above-described embodiment and the following modifications can be combined as long as the combined modifications remain technically consistent with each other.

In the above-described embodiment, the first relief groove 61 may extend obliquely with respect to the extending direction of the main arm 54 and the extending direction of the first auxiliary arm 561. In other words, the extending direction of the first relief groove 61 may be changed as long as it intersects with the extending direction of the main arm 54 and with the extending direction of the first auxiliary arm 561.

In the above-described embodiment, the second relief groove 62 may extend obliquely with respect to the extending direction of the second auxiliary arm 562. In other words, the extending direction of the second relief groove 62 may be changed as long as it intersects with the extending direction of the second auxiliary arm 562.

In the above-described embodiment, the first relief groove 61 may partially overlap with only the main arm 54. In this case, the fixed base plate 25*a* preferably includes a recessed auxiliary groove that intersects with the extending direction of the first auxiliary arm 561 and is not in contact with the first auxiliary arm 561.

In the above-described embodiment, the fixed base plate 25*a* does not necessarily need to include the first relief groove 61.

In the above-described embodiment, the fixed base plate 25*a* does not necessarily need to include the second relief groove 62.

In the above-described embodiment, the main reed valve 55 and the two auxiliary reed valves 57 may be separate members from each other in the fixed base plate 25*a*.

In the above-described embodiment, the number of the auxiliary discharge ports 41 is not particularly limited, but may be one or greater than two.

In the above-described embodiment, the axis of each auxiliary recess 43 may agree with the axis of the corresponding auxiliary discharge port 41.

In the above-described embodiment, the main reed valve 55 is substantially disc-shaped. However, the shape of the main reed valve 55 is not particularly limited.

In the above-described embodiment, each auxiliary reed valve 57 is substantially disc-shaped. However, the shape of each auxiliary reed valve 57 is not particularly limited.

In the embodiment, the scroll compressor 10 does not have to be driven by the motor 22 and may be driven by, for example, the engine of a vehicle.

In the above-described embodiment, the scroll compressor 10 is used in the vehicle air conditioner. However, the scroll compressor 10 may be used in other apparatuses. For example, the scroll compressor 10 may be mounted on a fuel cell electric vehicle and compress air that is fluid supplied to a fuel cell.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor, comprising:

a housing having a housing suction port that draws in fluid and a housing discharge port that discharges fluid;

a rotary shaft accommodated in the housing, the rotary shaft being supported by the housing to be rotatable about an axis of the rotary shaft; and a compression mechanism accommodated in the housing, the compression mechanism including:

a fixed scroll fixed to the housing; and an orbiting scroll configured to orbit about the axis as the rotary shaft rotates, wherein the housing includes:

a suction chamber into which fluid is drawn from the housing suction port;

a compression chamber that is connected to the suction chamber, fluid in the compression chamber being compressed through meshing of the fixed scroll and the orbiting scroll; and a discharge chamber connectable to the compression chamber, fluid being discharged to the discharge chamber from the compression chamber, the fixed scroll includes:

a disc-shaped fixed base plate; and a spiral fixed volute wall extending from the fixed base plate, the orbiting scroll includes:

a disc-shaped orbiting base plate that faces the fixed base plate; and a spiral orbiting volute wall that extends from the orbiting base plate toward the fixed base plate, a main discharge port is formed at a center of the fixed base plate, the main discharge port discharging compressed fluid to the discharge chamber, an auxiliary discharge port is formed in a portion of the fixed base plate that is different from the main discharge port, the auxiliary discharge port discharging fluid in the compression chamber to the discharge chamber when a pressure in the compression chamber is higher than or equal to a preset pressure, the fixed base plate includes:

a plate-shaped main reed valve configured to open and close the main discharge port; and a plate-shaped auxiliary reed valve configured to open and close the auxiliary discharge port, the main discharge port includes a main recess that opens toward the main reed valve so as to increase a cross-sectional area of a flow passage for the fluid discharged toward the main reed valve, the auxiliary discharge port includes an auxiliary recess that opens toward the auxiliary reed valve so as to increase a cross-sectional area of a flow passage for the fluid discharged toward the auxiliary reed valve, a sealing surface area, with which the fixed base plate and the auxiliary reed valve are in contact with each other to seal the auxiliary recess, is larger than a sealing surface area with which the fixed base plate and the main reed valve are in contact with each other to seal the main recess, a main arm is disposed between the main reed valve and the fixed base plate so as to connect the main reed valve and the fixed base plate to each other, the fixed base plate includes a recessed main groove that intersects with an extending direction of the main arm and is not in contact with the main arm, and a sealing surface area, with which the fixed base plate and the main reed valve are in contact with each other to seal the main recess, is defined by contact between the main reed valve and a portion of the fixed base plate that is on a side of the main groove on which the main discharge port is disposed.

2. The scroll compressor according to claim 1, wherein the auxiliary recess has a smaller opening area than the main recess, and the auxiliary reed valve has a larger area than the main reed valve.

3. The scroll compressor according to claim 1, wherein an auxiliary arm is disposed between the auxiliary reed valve and the fixed base plate so as to connect the auxiliary reed valve and the fixed base plate to each other, the fixed base plate includes a recessed auxiliary groove that intersects with an extending direction of the auxiliary arm and is not in contact with the auxiliary arm, and a sealing surface area, with which the fixed base plate and the auxiliary reed valve are in contact with each other to seal the auxiliary recess, is defined by contact between the auxiliary reed valve and a portion of the fixed base plate that is on a side of the auxiliary groove on which the auxiliary discharge port is disposed.

4. A scroll compressor, comprising:

a housing having a housing suction port that draws in fluid and a housing discharge port that discharges fluid;

a rotary shaft accommodated in the housing, the rotary shaft being supported by the housing to be rotatable about an axis of the rotary shaft; and a compression mechanism accommodated in the housing, the compression mechanism including:

a fixed scroll fixed to the housing; and an orbiting scroll configured to orbit about the axis as the rotary shaft rotates, wherein the housing includes:

a suction chamber into which fluid is drawn from the housing suction port;

a compression chamber that is connected to the suction chamber, fluid in the compression chamber being compressed through meshing of the fixed scroll and the orbiting scroll; and a discharge chamber connectable to the compression chamber, fluid being discharged to the discharge chamber from the compression chamber, the fixed scroll includes:

a disc-shaped fixed base plate; and a spiral fixed volute wall extending from the fixed base plate, the orbiting scroll includes:

a disc-shaped orbiting base plate that faces the fixed base plate; and a spiral orbiting volute wall that extends from the orbiting base plate toward the fixed base plate, a main discharge port is formed at a center of the fixed base plate, the main discharge port discharging compressed fluid to the discharge chamber, an auxiliary discharge port is formed in a portion of the fixed base plate that is different from the main discharge port, the auxiliary discharge port discharging fluid in the compression chamber to the discharge chamber when a pressure in the compression chamber is higher than or equal to a preset pressure, the fixed base plate includes:

a plate-shaped main reed valve configured to open and close the main discharge port; and a plate-shaped auxiliary reed valve configured to open and close the auxiliary discharge port, the main discharge port includes a main recess that opens toward the main reed valve so as to increase a cross-sectional area of a flow passage for the fluid discharged toward the main reed valve, the auxiliary discharge port includes an auxiliary recess that opens toward the auxiliary reed valve so as to increase a cross-sectional area of a flow passage for the fluid discharged toward the auxiliary reed valve, and a sealing surface area, with which the fixed base plate and the auxiliary reed valve are in contact with each other to seal the auxiliary recess, is larger than a sealing surface area with which the fixed base plate and the main reed valve are in contact with each other to seal the main recess, an auxiliary arm is disposed between the auxiliary reed valve and the fixed base plate so as to connect the auxiliary reed valve and the fixed base plate to each other, the fixed base plate includes a recessed auxiliary groove that intersects with an extending direction of the auxiliary arm and is not in contact with the auxiliary arm, and a sealing surface area, with which the fixed base plate and the auxiliary reed valve are in contact with each other to seal the auxiliary recess, is defined by contact between the auxiliary reed valve and a portion of the fixed base plate that is on a side of the auxiliary groove on which the auxiliary discharge port is disposed.

* * * * *